US011980804B1

(12) United States Patent
Bailey et al.

(10) Patent No.: US 11,980,804 B1
(45) Date of Patent: May 14, 2024

(54) SKI POLE BASKET AND SKI POLE AND METHODS OF USE THEREOF

(71) Applicants: Dorian Bailey, Denver, CO (US); Broby Leeds, Denver, CO (US)

(72) Inventors: Dorian Bailey, Denver, CO (US); Broby Leeds, Denver, CO (US)

( * ) Notice: Subject to any disclaimer, the term of this patent is extended or adjusted under 35 U.S.C. 154(b) by 0 days.

(21) Appl. No.: 18/494,477

(22) Filed: Oct. 25, 2023

Related U.S. Application Data

(60) Provisional application No. 63/430,377, filed on Dec. 6, 2022.

(51) Int. Cl.
*A63C 11/24* (2006.01)
*A63C 11/22* (2006.01)

(52) U.S. Cl.
CPC ..... *A63C 11/227* (2013.01)

(58) Field of Classification Search
CPC ..... A63C 11/227; A63C 11/228; A63C 11/24; A47G 25/80
See application file for complete search history.

(56) References Cited

U.S. PATENT DOCUMENTS 4,666,070 A * 5/1987 McClung ..... A47G 25/80 223/117
8,973,946 B2 3/2015 Carr
9,149,140 B1 * 10/2015 Weakley ..... A47G 25/80
2004/0124626 A1 7/2004 Kraabel
2009/0058064 A1 * 3/2009 Ford, III ..... A63C 11/24 280/824
2009/0236377 A1 * 9/2009 Selvarajah ..... A43B 5/0425 223/115
2010/0264174 A1 * 10/2010 Anderson, Jr. ..... A47G 25/80 223/113
2011/0269108 A1 * 11/2011 Coleman ..... A63C 5/16 434/253
2013/0264810 A1 * 10/2013 Carr ..... A63C 11/227 280/821
2016/0374490 A1 * 12/2016 Johnson ..... A47G 25/80 223/114
2017/0303642 A1 10/2017 Norheim
2018/0256966 A1 * 9/2018 Owen ..... A63C 11/24
2019/0029450 A1 * 1/2019 Crowley, Jr. ..... A47G 25/80
2019/0070483 A1 * 3/2019 Zoor ..... A63C 9/0847

* cited by examiner

*Primary Examiner* — Brian L Swenson
(74) *Attorney, Agent, or Firm* — Leyendecker & Lemire LLC

(57) ABSTRACT

A ski pole basket, typically made of a polymeric material, that includes at least one generally rigid portion with a specifically shaped perimeter/interface configured to interface with the heel lip of a ski boot is described. When the basket is attached to a ski pole, a skier can use the pole to press down on the ski boot while he/she removes his/her foot from the boot while in a substantially erect standing position.

16 Claims, 6 Drawing Sheets

SKI POLE BASKET AND SKI POLE AND METHODS OF USE THEREOF

RELATED APPLICATIONS

This application claims the benefit of U.S. Provisional patent application No. 63/430,377, entitled Ski Pole Basket and Ski Pole and Methods of Use Thereof, filed on Dec. 6, 2022, which as the same inventorship as the present application.

BACKGROUND

Ski poles are commonly if not almost universally used while skiing. They are used while actively skiing down a trail for balance, rhythm, timing, and support. They are also used as a means of transferring force from the arms to the snow-covered ground when climbing up a slope or gliding over a flat section. Ski poles also are used as a tool, such as to knock snow off of a boot before inserting the boot into a binding or releasing the boot from a binding.

Most ski poles include baskets several inches from their distal ends. They typically serve the singular purpose of reducing the penetration of the pole into the snow during use. Many baskets are generally circular having a diameter that can depend on the type of snow in which the associated person is skiing. For instance, larger diameter baskets having a larger surface area are used in lightly packed snow, such as powder, wherein smaller baskets with less surface area are used for densely packed snow.

Ski pole baskets are typically made of a thin semi-flexible plastic material. The basket is often snap and friction fit over a ferrule that is securely mounted to the pole. The ferrule typically has an upper circumferential upper ridge and a circumferential lower ridge. A center bore of the basket resiliently deforms as it is pushed over the lower ridge and snaps back to its nominal diameter once positioned between the ridges effectively securing it in place. Variations of the ferrule are also known that allow threaded receipt of the basket thereon or include a threaded nut that tightens over the ferrule in place of the lower ridge to secure the basket in place.

DETAILED DESCRIPTION

Overview

Embodiments of the present invention comprise a ski pole basket, typically made of a polymeric material, that includes at least one generally rigid portion with a specifically shaped perimeter/interface configured to interface with the heel lip of a ski boot. When the basket is attached to a ski pole, a skier can use the pole to press down on the ski boot while he/she removes his/her foot from the boot while in a substantially erect standing position.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive, rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, upper, lower, vertical, horizontal, back, front and lateral are relative to each other and are dependent on the specific orientation of an applicable element or article, and are used accordingly to aid in the description of the various embodiments and are not necessarily intended to be construed as limiting.

Unless otherwise indicated or dictated by context, the terms "approximately" and "about" mean +−20%. Unless otherwise indicated or dictated by context, the term "substantially" means +−10%. The term "generally" means for the most part.

The term "concave" as used herein pertains to an edge or perimeter that is inwardly indented. The surface of the indent can be curved, such as the arc of a circle or comprise a combination of straight lines or a combination of straight and curved lines.

Embodiments of a Ski Pole Basket Configured to Assist in Boot Removal

Figures 6A, 6B, 6C:
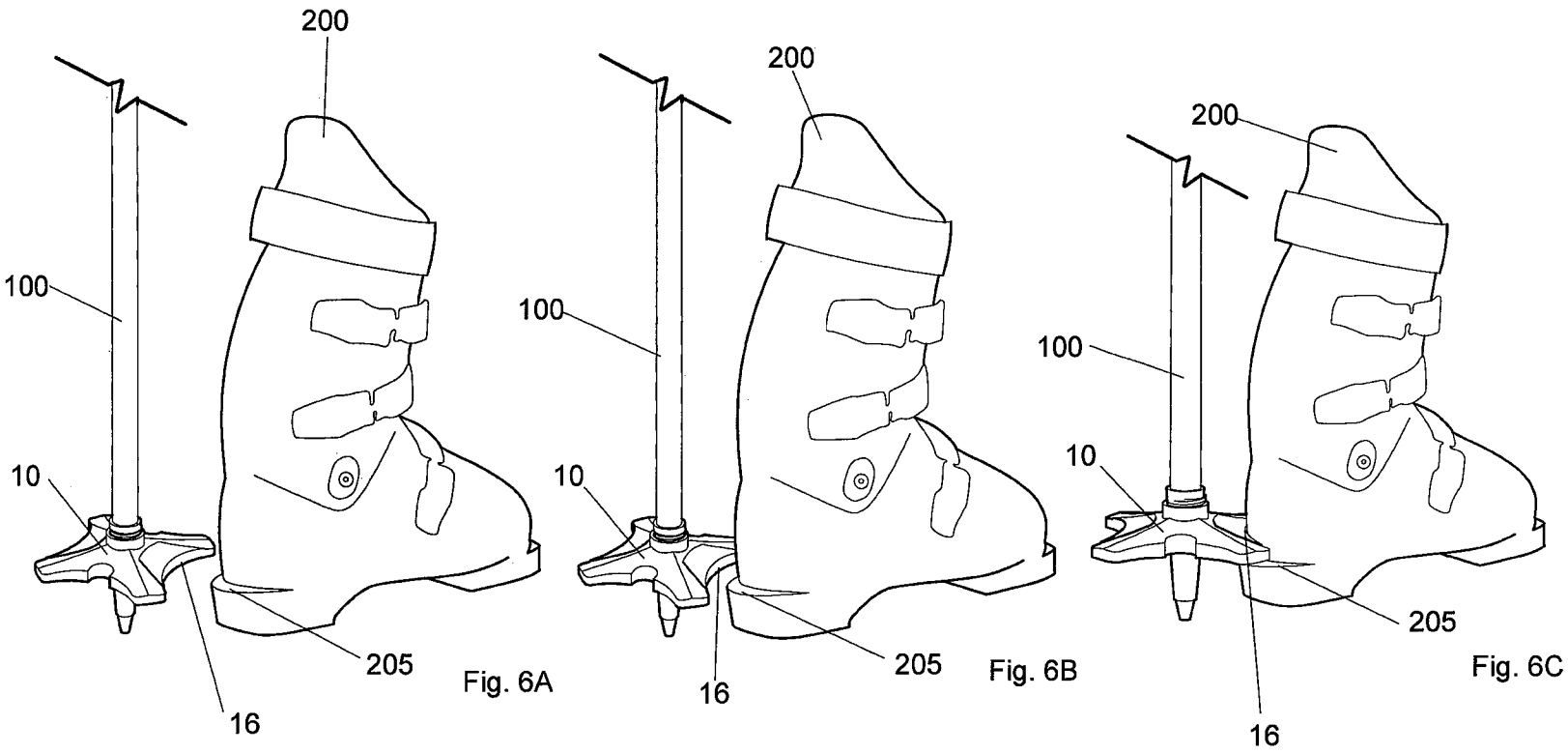
FIG. 6A-C are perspective views showing a ski boot and demonstrating how a ski pole that includes an embodiment of the ski basket interface with the heel lip of the boot during use.

Almost universally, downhill ski boots 200 comprise both a heel lip 205 and toe box lip 210 as can be seen in FIGS. 6A-C. These lips are configured to permit the boot to be mounted to skis by way of bindings. The configurations of the ski boot lips are typically standardized to allow most any ski boot to function with most any set of bindings. Of importance to embodiments of the present invention, the heel lip 205 typically comprises an arc having a radius of 1.5" proximate the lip's interface with the generally vertically and upwardly extending back of the heel. It is this heel lip that embodiments of the ski pole basket 10, 10A-G are configured to interface and facilitate using a ski pole to assist in the removal of a ski boot.

Figure 1A:
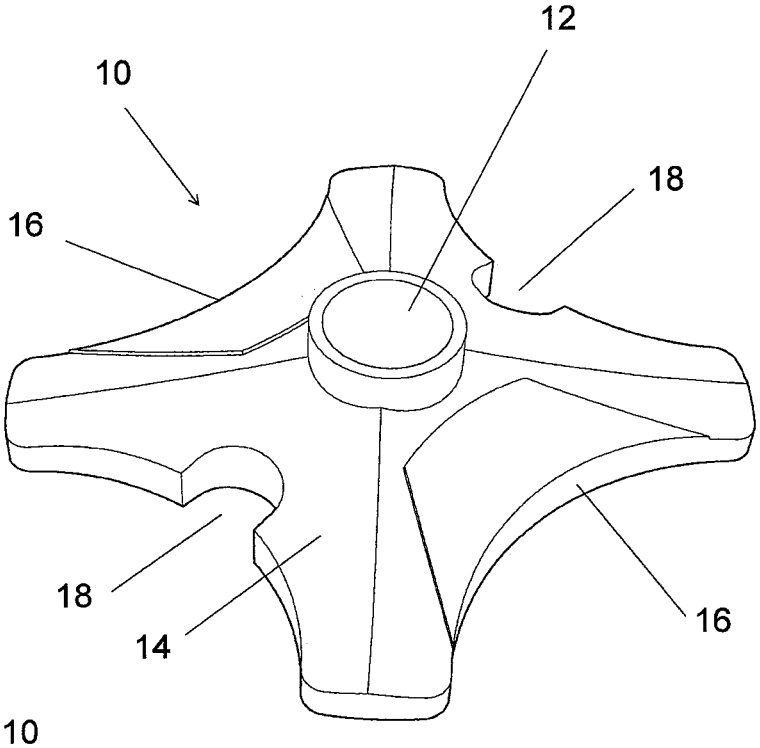
FIGS. 1A & 1B are perspective views of a ski pole basket according to an embodiment of the present invention.
Figure 1B:
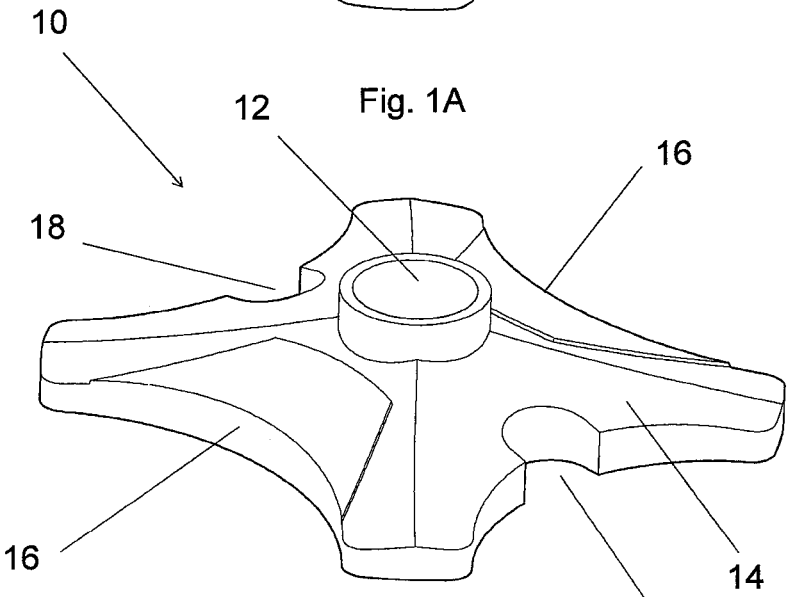
Figure 2:
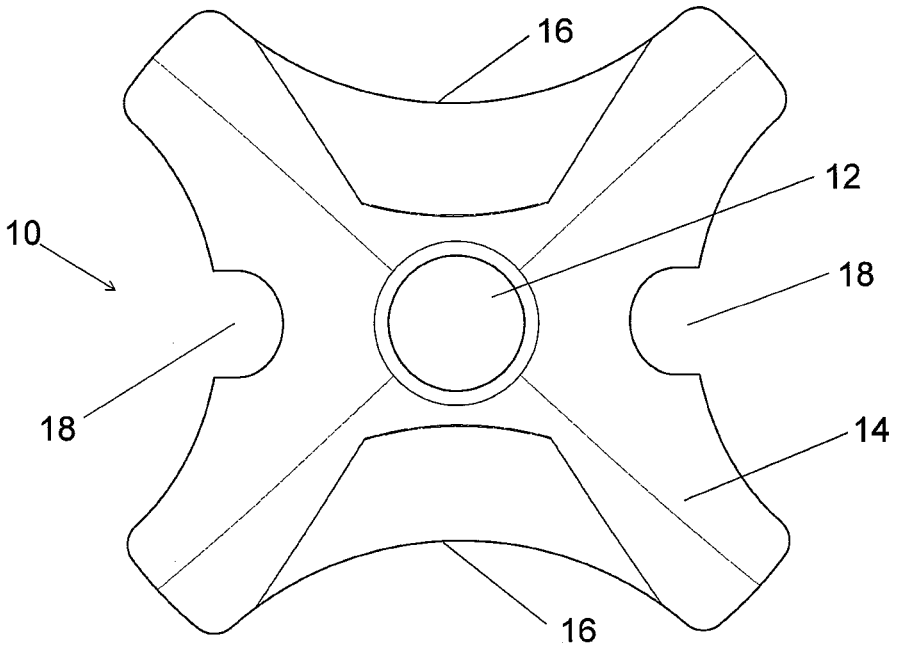
FIG. 2 is a top view of the ski pole basket according to an embodiment of the present invention.
Figure 3:
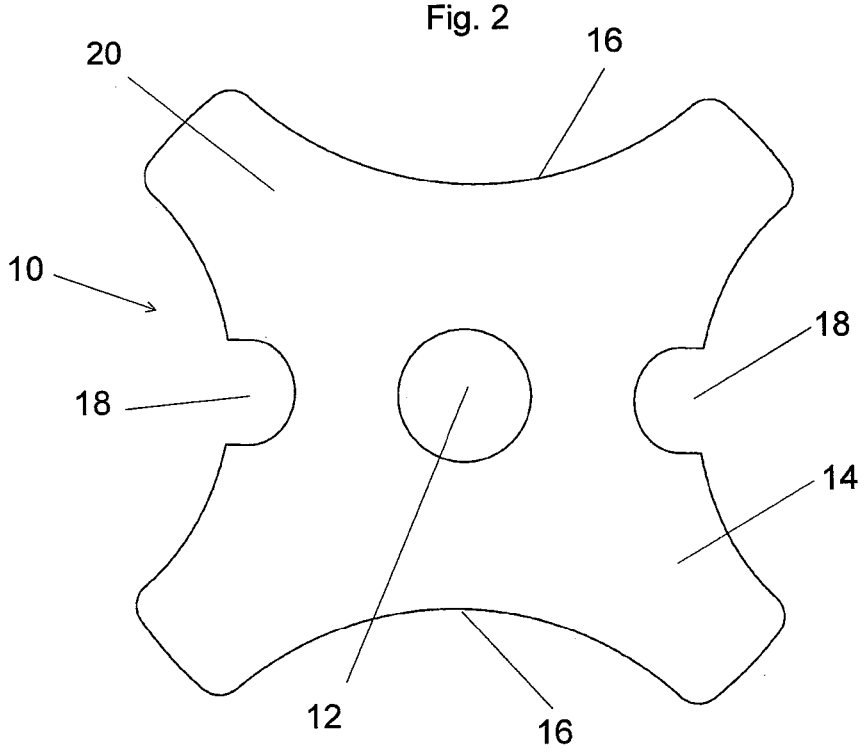
FIG. 3 is a bottom view of the ski pole basket according to an embodiment of the present invention.
Figure 4:
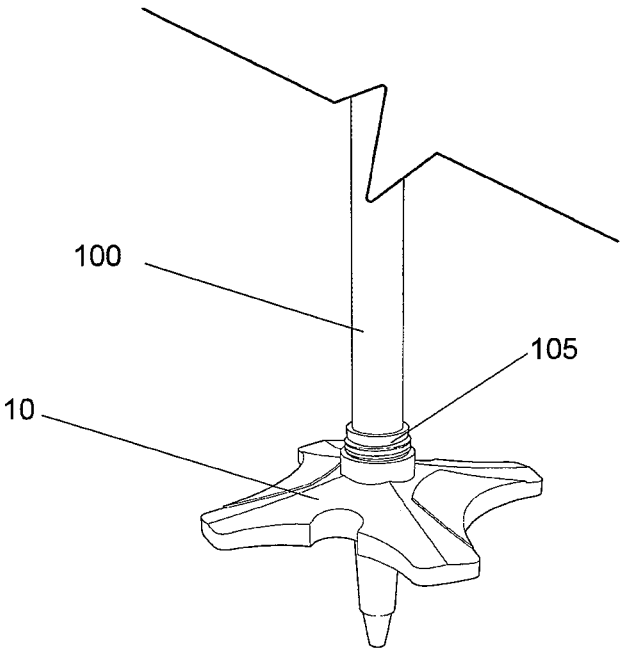
FIG. 4 is a perspective view of the ski pole basket installed on the end of a ski pole according to an embodiment of the present invention.

FIGS. 1-4 illustrate an embodiment of a ski pole basket 10 configured to mount to a ski pole 100 and interface with the heel lip 205 of a ski boot 200. The single piece unitarily-formed basket is characterized by a ski pole mounting bore 12 at the basket's center and a body 14 that radiates outwardly therefrom. The specific configuration of the mounting bore can vary depending on the basket mount (or ferrule) 105 of an associated ski pole 100 on which the basket is configured to mount. Several different styles of ski pole basket mounts are known. A threaded basket mount 105 is illustrated in FIG. 4; wherein, a threaded basket mounting bore 12 includes complimentary threads formed on its circumferential surface to be threadably received and secured to the basket mount.

In other variations, the basket 10 can be snap or friction fit on a basket mount 105 having annular top and bottom lips that hold the basket in place once it is seated thereon. In yet other variations, two or more pins may extend outwardly from the basket mount that correspond with slots formed in the mounting bore such that the basket can be locked in place by engaging the pins in the slots. Other mounting mechanisms are contemplated for securing a ski basket to a ski pole including, but not limited to, structurally enhanced mounting mechanisms constructed and configured to facilitate the transfer of the necessary load to assist in the removal of a ski boot.

The body 14 typically includes a generally flat bottom surface 20 that is orthogonal to the axis of the mounting bore 12. The surface area of the body's bottom surface can vary with versions configured for soft snow generally have a larger area, and versions configured for harder snow having a smaller area. The area of bottom surface are often matters of personal preference of a skier. Accordingly, embodiments of the ski basket 10 can be produced in a variety of sizes.

As is evident in the figures, the basket 10 comprises four concave sides. At least one of the sides comprises a heel lip interface 16. In the illustrated embodiment, two opposing sides comprise heel lip interfaces. It is appreciated that variations are contemplated wherein three sides or even all sides can be configured as heel lip interfaces. The heel lip interface is characterized by its radius (or effective radius), which substantially matches the radius of the arc of the boot's heel lip 205. Accordingly, the radius of the arc is typically substantially 1.5". It is appreciated that for boots having different heel lip radii, the radii of the associated ski pole baskets can vary to match the boots 200.

The two other sides are also concave although in this particular embodiment they are not sized to be received against a boot's heel lip 205. It is appreciated that the size and configuration of these sides can vary substantially and significantly from the illustrated embodiment. Of particular note, opposing annular notches 18 are provided at the center of the sides concave edge. The notches are sized and configured to snappily receive a tubular section of a ski pole roughly proximate the poles tip therein. This permits a user to join two poles together making the pair easier to carry to and from the ski area.

The thickness of a body of a typical prior art ski pole basket is relatively thin, such as about 0.1", and is most often comprised of a relatively low modulus flexible plastic. At this thickness, a prior art basket is unable to effectively transfer load between its edge and the mounting bore. In contrast, the thickness of embodiments of the basket 10 are substantially thicker and/or comprised of stiffer plastic materials. In the illustrated variation the thickness of the basket at the center of the arc of the heel lip interface 16 is about 0.250" thick and located about 1" from the axis of the mounting bore 12. The thickness of the portion of the body 14 extending between the mounting bore and the interface is at least as thick, and in the illustrated embodiment becomes thicker closer to the mounting bore. Adjacent the mounting bore, the illustrated embodiment is about 0.35" thick with its thickness tapering as it extends towards the heel lip interface. Resultingly, the embodiment is capable of effectively transfer load between the ski pole and the heel lip without undue flexing even when comprised of a semirigid resilient elastomer, such as polyurethane having a Shore D hardness of about 60.

As shown, the generally vertical face of the heel lip interface 16 is substantially smooth. In variations, the face can be textured, such as ridges, grooves, and peaks, to assist in gripping against the boot when placed in contact with the heel lip. The textured surface can be molded into the face during fabrication or it can comprise a material added thereafter, such as a coating or an adhesively-applied strip of grippy or abrasive material. It is further appreciated that a textured or grippy surface can be provided on the bottom surface 20 of the basket in the area proximate the heel lip interface 16 to enhance grip on the horizontal portions of the heel lip 205.

Figure 5A:
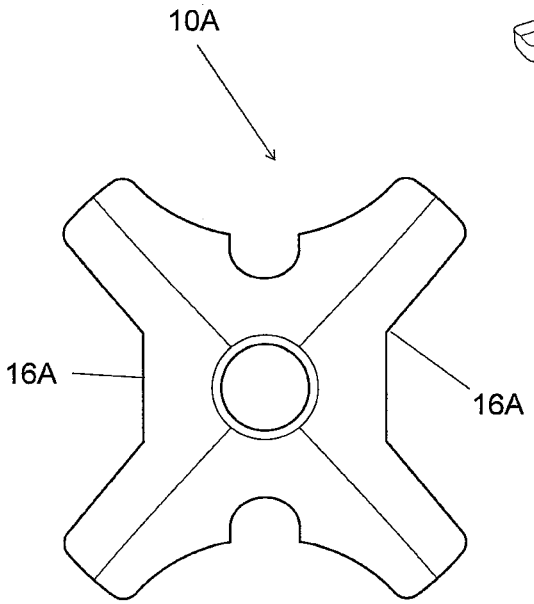
FIGS. 5A & 5B illustrate two different variations of the ski boot heel lip interface according to embodiments of the present invention.
Figure 5B:
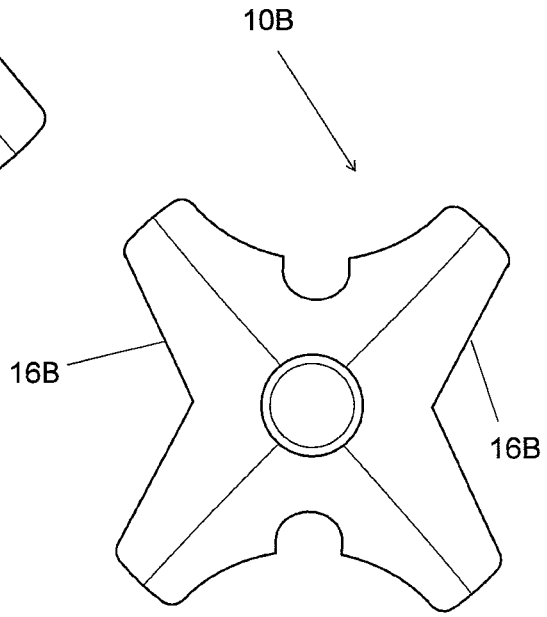

FIGS. 5A & 5B show other embodiments 10A& 10B of the ski basket that are substantially similar to the embodiment described above but differ relative to the shape of the heel lip interface 16A & 16B. The embodiment of FIG. 5A comprises a generally symmetrical three-sided interface sized and is configured to nest against an arcuate heel boot lip 205 with the face of the interface making contact with the generally vertical side of the boot at three location or points. The embodiment of FIG. 5B comprises a generally symmetrical V-shaped two-sided interface 16B sized and configured to nest against an arcuate heel boot lip 205 with the face of the interface making contact with the generally vertical side of the boot at two locations or points. As can be appreciated, the shape of the interface can vary so long as sufficient contact between the bottom surface 20 of the basket and the top horizontal surface of the heel lip 205 can be made to facilitate the transfer of force therebetween. The shape of the interface 16 is likewise important in that it assists in centering the basket on the heel lip inhibiting the basket from sliding off one side of the heel lip.

The embodiments of the basket 10 can be comprised of anyone of a number of polymeric materials that facilitate the transfer of load from the heel lip interface 16 to the mounting bore 12. In one embodiment, a thermoset polyurethane elastomer that cures into a semi-rigid material having a Shore D hardness of about 60 is used, such as Smooth-Cast 60 D, made by Smooth-On, Inc. of Macungie, PA. For a basket made of polyurethane having a hardness of about 60 D, the basket is between 0.20-0.50" thick at the heel lip interface.

In other variations other materials can be utilized such as, but not limited to, nylon, polycarbonate, ABS (acrylonitrile butadiene styrene), polypropylene and thermoplastic polyurethane. The hardness and moduli of the various vary and the resulting geometry of a basket 10 made of a particular material is adjusted to ensure the basket is capable of transferring the necessary amount of load from the ski pole 100 to the boot 200 while also provide a measure of flexibility and resiliency as is often desired in a ski pole basket as is performing its traditional function.

The embodiments of the baskets 10 can be manufactured by any suitable methods; however, thermoset polyurethane baskets are usually pour molded and/or reaction injection molded as a single unitary piece. Baskets made of a thermoplastic material can be injection molded typically as a single unitary piece. In variations, such as those comprising a reinforced or metal mounting bore, mounting bore inserts can be secured to the body of the basket in a post-molding operation, or the insert can be placed into the mold prior to molding such that the body of the basket is formed around the insert during the injection or reaction molding operation.

As can be appreciated, the physical properties of a particular basket 10 are determined by both the basket's material, and the dimensions and configuration of the basket. For example, a basket comprised of glass reinforced nylon would typically be much thinner that a basket comprised of a polyurethane elastomer that has similar load transferring characteristics. Further, a larger basket with a greater distance from the axis of the mounting bore and the face of the heel lip interface would require a thicker basket than one with having a shorter distance.

Figure 7:
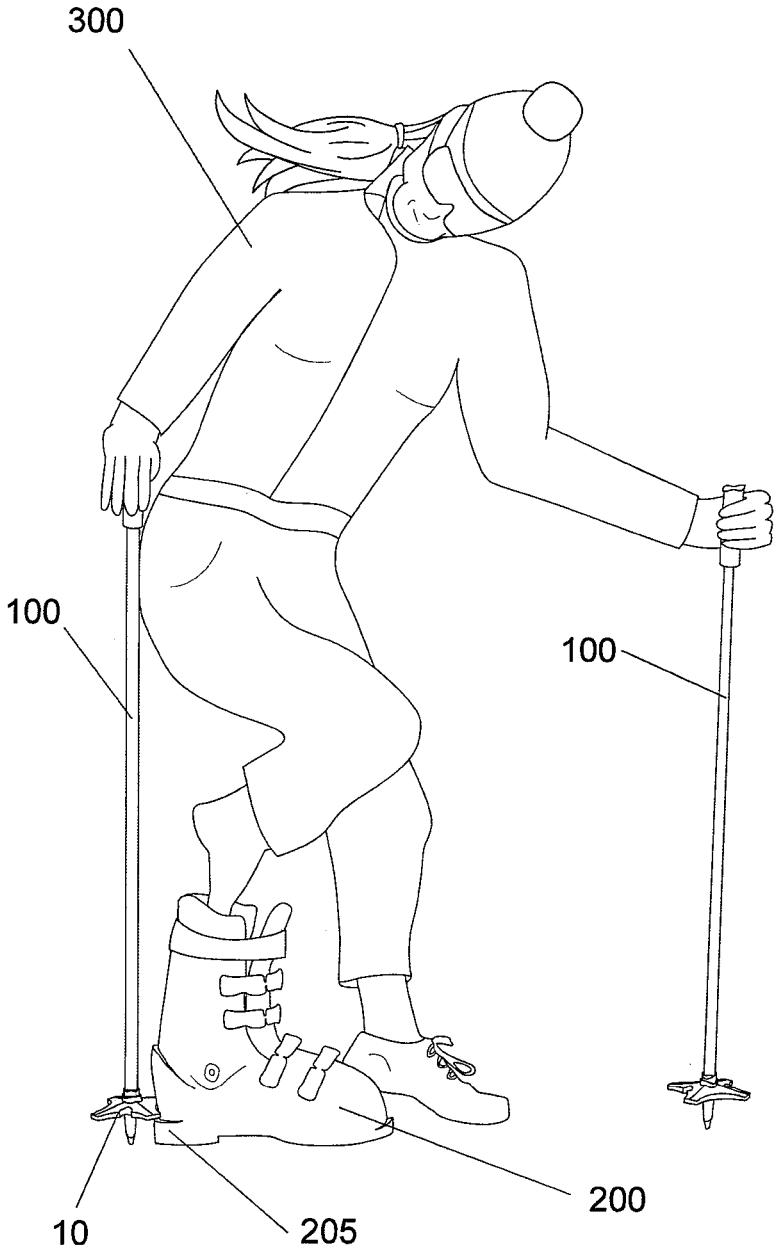
FIG. 7 illustrates a skier using the basket attached to a ski pole to remove her ski boot according to an embodiment of the present invention.

Methods of Using an Embodiment of the Ski Boot Basket to Assist in Removing a Ski Boot FIG. 6 A-C and FIG. 7 illustrate how a skier 300 uses a ski pole 100 with an embodiment of the basket 10 secured thereto to assist in the removal of the skier's ski boot 200 while she is standing substantially upright. After unbuckling the boot 200, the skier, while standing and holding the ski pole in one hand, places the specifically shaped heel lip interface 16 against and resting on the heel lip 205 as illustrated in FIGS. 6 A-C. Next, while holding the pole substantially vertically and pressing downwardly as shown in FIG. 7 to hold the boot against the ground surface, the skier pulls her foot from the boot. As desired, the process can be repeated for the skier's other boot. Additionally, the ski pole and basket combination can be used to stabilize and hold a ski boot in place while a skier puts on her boots.

Other Embodiments and Variations

The particular basket designs shown and described herein are merely examples and numerous variations are contemplated in a variety of shapes, sizes, materials, and pole mounting mechanisms that incorporate the same structural features and functionality as recited in the various claims. For instance, the embodiments of the basket described herein are substantially solid, but although variations are known wherein gussets and reinforcing grids are employed instead of or in addition to a thick solid portion to provide enhanced strength and stiffness to efficiently transfer load while using less plastic.

Figure 8:
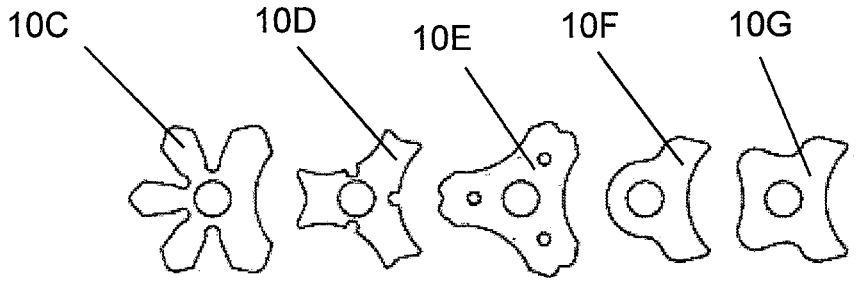
FIG. 8 are bottom view illustrations of ski baskets having a variety of shapes according to embodiments of the present invention.

Additionally, the shape of the basket can vary substantially in variations. The illustrated embodiment is merely one example of the myriad of possible shapes. Several embodiments of ski baskets 10C-G having different shapes are shown in FIG. 8. Each of the embodiment includes a heel lip interface wherein the body portion between the interface and the mounting bore is sufficiently thick or reinforced to transfer load between the pole and the ski boot.

Figure 9:
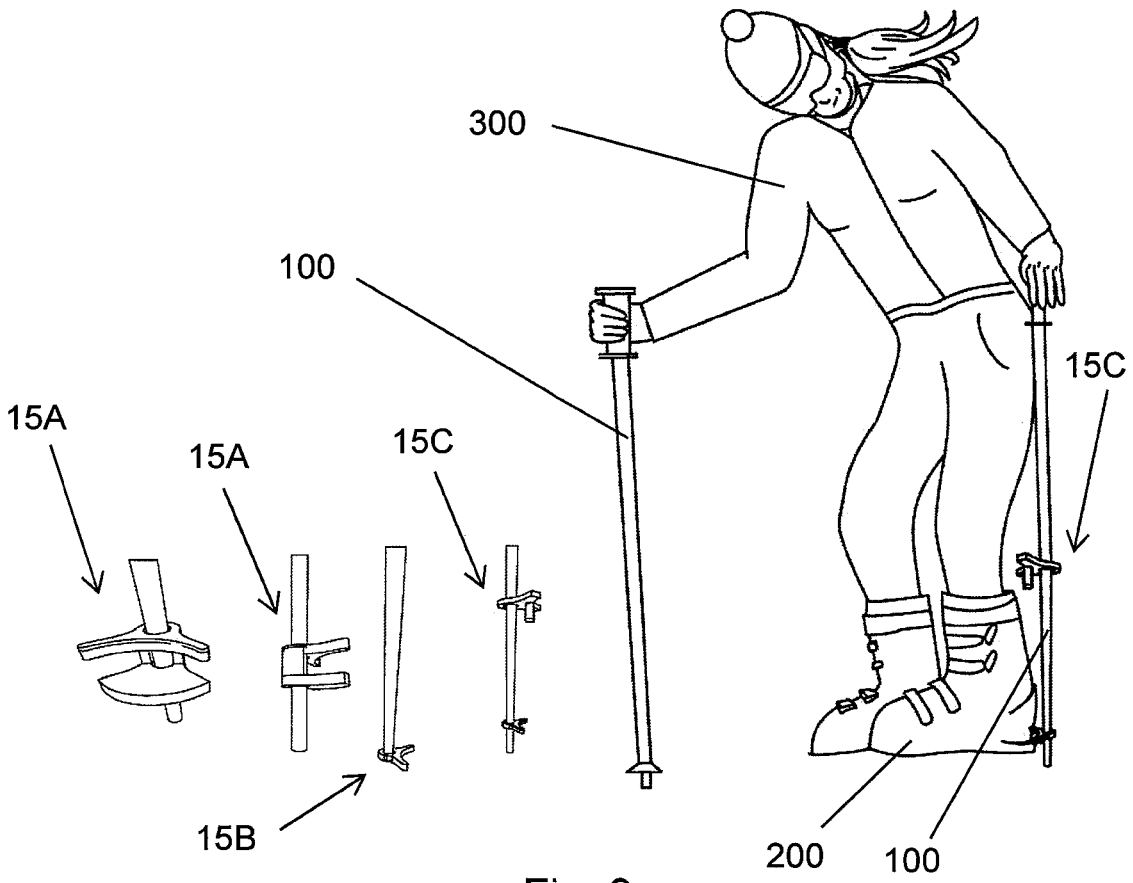
FIG. 9 are perspective views of ski pole mounted ski boot removal devices according to embodiments of the present invention.

FIG. 9 illustrates several alternative devices 15A-C that can be attached to a ski pole 100 to assist in the removal of a ski boot 200. These devices need not be a ski pole basket or associated with a ski pole basket. In some variations; however, the alternative devices can be used in conjunction with an embodiment of the ski pole basket 10 described herein. These alternative devices can be mounted higher up on a ski pole above the pole's basket. The leftmost device 15A, shown from two different perspectives, fits over and under the heel lip 205 of a ski boot 200, but is mounted above the basket on the ski pole 100. The next device 15B is distinct from a ski pole basket but essentially comprises a ski boot removal portion. Again, this device can be mounted above the basket on a ski pole. The rightmost device 15C has two parts with a boot heel removal portion, either as part of a ski basket 10 or distinct therefrom and a second portion configured to hook into and attach to the top opening of the boot. Broadly, embodiments of the present invention aren't limited to a specifically configured ski pole basket, but any device that attaches to a ski pole to help facilitate ski boot removal.

We claim:

1. A ski pole basket comprising:

a mounting bore, the mounting bore being configured for received over and securement to a shaft of a ski pole proximate a distal end of the ski pole;

a body surrounding and extending outwardly from the mounting bore; and at least one ski boot heel lip interface, the at least one ski boot heel interface being concave and configured to rest on a ski boot heel lip;

wherein a portion of the body extending from the mounting bore to the at least one ski boot heel lip interface is substantially rigid and configured to transmit the force of a user of the ski pole pressing down on the pole to the ski boot when the at least one ski boot heel lip interface is resting on the ski boot heel lip; and wherein the at least one ski boot heel lip interface is arcuate and has a radius of substantially 1.5".

2. The ski boot basket of claim 1, wherein the mounting bore is threaded.

3. The ski boot basket of claim 1, wherein the mounting bore includes a metal reinforcing sleeve.

4. The ski boot basket of claim 1, wherein the ski boot basket consists of a single unitarily fabricated piece of polymeric material.

5. The ski boot basket of claim 4, wherein the polymeric material comprises one of thermoset polyurethane, thermoplastic polyurethane, polypropylene, and nylon.

6. The ski boot basket of claim 4, wherein the ski boot basket is comprised of polyurethane having a Shore D hardness of about 60.

7. The ski boot basket of claim 6, wherein a face of the at least one ski boot heel lip interface is about 0.25" thick at a center location along a length of the face.

8. The ski pole basket of claim 1, wherein a bottom of the body is generally flat.

9. The ski pole basket of claim 1, wherein a bottom of the body proximate the at least one ski boot heel lip interface is substantially orthogonal to a face of the at least one ski boot heel lip interface.

10. The ski boot basket of claim 1, further comprises one or more annular notches configured to receive the tubular shaft of a ski pole other than the ski pole on which the basket is secured therein to join two ski poles together for transport.

11. A ski pole basket comprising:

a mounting bore, the mounting bore being configured for received over and securement to a shaft of a ski pole proximate a distal end of the ski pole;

a body surrounding and extending outwardly from the mounting bore; and at least one ski boot heel lip interface, the at least one ski boot heel interface being concave and configured to rest on a ski boot heel lip;

wherein a portion of the body extending from the mounting bore to the at least one ski boot heel lip interface is substantially rigid and configured to transmit the force of a user of the ski pole pressing down on the pole to the ski boot when the at least one ski boot heel lip interface is resting on the ski boot heel lip; and wherein a face of the at least one ski boot heel lip interface is about 0.25" thick at a center location along a length of the face.

12. The ski boot basket of claim 11, wherein the face is textured.

13. A method of using a ski pole in combination with a ski pole basket wherein (a) the ski pole basket comprises (i) a mounting bore, the mounting bore being configured for received over and securement to a shaft of a ski pole proximate a distal end of the ski pole, (ii) a body surrounding and extending outwardly from the mounting bore, and (iii) at least one ski boot heel lip interface, the at least one ski boot heel interface being concave and configured to rest on a ski boot heel lip with a portion of the body extending from the mounting bore to the at least one ski boot heel lip interface is substantially rigid and configured to transmit the force of a user of the ski pole pressing down on the pole to the ski boot when the at least one ski boot heel lip interface is resting on the ski boot heel lip, and (b) the ski boot basket is received over a shaft of the ski pole the method comprising:

by a skier wearing one or two ski boots while holding the ski pole in a hand and standing generally upright, placing the at least one ski boot heel lip interface against the heel lip of a ski boot of the one or two ski boots;

the skier applying a downward force against the ski boot by way of the ski pole and ski basket to hold the ski boot against the ground; and the skier pulling his/her foot from the ski boot while applying the downward force.

14. A ski pole basket molded from single unitarily fabricated piece of polymeric material, the ski pole basket further comprising:

a mounting bore, the mounting bore being configured for received over and securement to a shaft of a ski pole proximate a distal end of the ski pole;

at least one ski boot heel lip interface, the at least one arcuate ski boot heel interface being concave, having a radius of substantially 1.5", and being configured to rest on a ski boot heel lip; and a body surrounding and extending outwardly from the mounting bore, a bottom of the body proximate the at least one ski boot heel lip interface being substantially orthogonal to a face of the at least one ski boot heel lip interface;

wherein the portion of the body extending from the mounting bore to the at least one ski boot interface is substantially rigid and configured to transmit the force of a user of the ski pole pressing down on the pole to the ski boot when the at least on ski boot heel lip interface is resting on the ski boot heel lip.

15. The ski pole basket of claim 14, wherein the ski boot basket is comprised of polyurethane having a Shore D hardness of about 60.

16. The ski pole basket of claim 15, wherein a face of the at least one ski boot heel lip interface is about 0.25" thick at a center location along a length of the face.

* * * * *